US005650581A

United States Patent [19]

Sigrist

[11] Patent Number: 5,650,581

[45] Date of Patent: Jul. 22, 1997

[54] JACK BASE FOR ELECTRIC MUSICAL INSTRUMENTS

[76] Inventor: Erik O. Sigrist, 19275 SW. Anderson, Aloha, Oreg. 97007

[21] Appl. No.: 375,975

[22] Filed: Jan. 20, 1995

[51] Int. Cl.[6] ..... G10D 3/00

[52] U.S. Cl. ..... 84/291; 84/743; 439/381; 439/669

[58] Field of Search ..... 84/291, 723, 725, 84/726, 727, 743; 439/374, 380, 381, 668, 669

[56] References Cited

U.S. PATENT DOCUMENTS

| | | | |
|---|---|---|---|
| 4,519,287 | 5/1985 | Naruse | 84/727 |
| 4,532,847 | 8/1985 | Youngblood | 84/727 |
| 4,941,389 | 7/1990 | Wendler | 84/727 |
| 5,010,802 | 4/1991 | Lanham | 84/743 |
| 5,042,356 | 8/1991 | Karch | 84/725 |
| 5,409,403 | 4/1995 | Falossi et al. | 439/668 |

*Primary Examiner*—Cassandra C. Spyrou
*Attorney, Agent, or Firm*—Keith A. Cushing

[57] ABSTRACT

A jack base for electrical musical instrument, e.g., electric guitar, improves mounting stability and makes easier the placement of an electric jack therein. The jack base presents a concave surface accepting and guiding the jack into the jack hole without protrusions or interfering surface structures. The jack base mounts to a standard jack base mounting hole, but offers opportunity for mounting of screws at angled orientation with great resistance to loosening thereof.

14 Claims, 9 Drawing Sheets

FIG. 9A
(Prior Art)
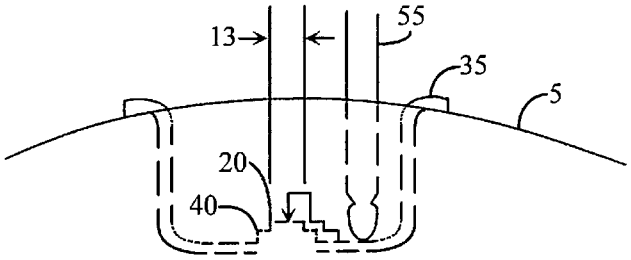
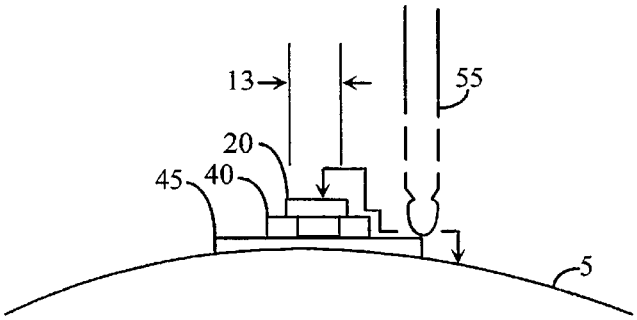
FIG. 9B
(Prior Art)
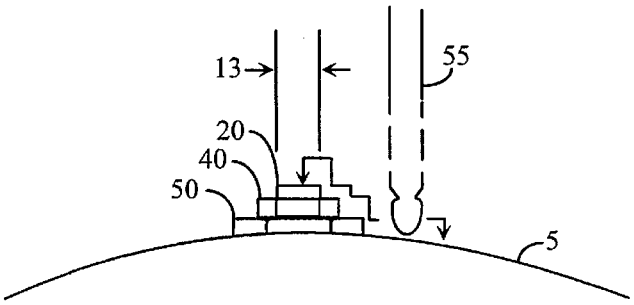
FIG. 9C
(Prior Art)
FIG. 9D
(Prior Art)
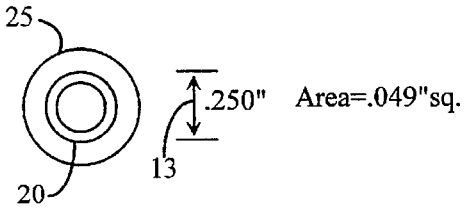

JACK BASE FOR ELECTRIC MUSICAL INSTRUMENTS

BACKGROUND OF INVENTION

1. Field of Invention

This invention relates generally to electric musical instruments, and particularly to an improved mounting base for an input jack on an electric guitar.

2. Prior Art

Electric guitars all employ the use of a ¼ inch standard phono jack to connect the instrument to an electric amplifier. The female half of the connector mounts on the instrument, typically positioned out of the musician's sight, on the lower, rear side of the instrument. In one method of construction, the jack fastens to the instrument by mounting in a curved plate following the curved surface contour of the guitar body. The curved plate, in ram, fastens to the guitar body. The plate connects to the guitar body with #2 or #3 wood screws. Most guitar bodies are relatively soft woods such as alder, mahogany, basswood, poplar, etc., and these small screws often strip away from the soft wood.

The jack is connected to the plate by use of a nut on the outside of the plate with a backing nut on the inside of the plate. The nuts engage a threaded ferrule of the female jack running through the jack plate. In some cases, just one nut fastens the jack ferrule to the plate. In such case, the length of ferrule not used in mounting must protrude from the guitar as there is no backing nut for adjustment in ferrule position.

Jack plates, stamped into a concave shape are known, for example the Fender® Stratocaster® guitar provides a teardrop shape and the Fender® Telecaster® guitar provides a cup shaped jack place. (The terms "FENDER®", STRATOCASTER®, and TELECASTER® are registered trademarks of FENDER MUSICAL INSTRUMENTS, INC.) The Fender® Telecaster® electric guitar has been in production since 1950. It was the first mass produced electric guitar and it spans a whole musical genre. Virtually every major electric guitar manufacturer has a Telecaster®-style model in production. A 1994 issue of Guitar Player magazine had a Telecaster®-style guitar review of 32 different models. The Telecaster® guitar is now more popular than ever.

The jack plate of the Fender® Telecaster® guitar mounts to the body of the guitar without using screws. Instead, as described more fully below, it uses a smaller secondary plate that wedges inside the mounting hole of the instrument when the nut on the outside of the jack plate tightens. The smaller secondary plate often works loose during use. With instrument use, any force applied to the wedge, e.g., bending it beyond its original form, loosens the wedge material, which is typically thin and soft. This inherent weakness is made worse by a large hole drilled through the middle to allow the jack ferrule to pass through. This arrangement limits the amount of torque used when tightening the nut on the outside of the jack. If the nut is over-tightened, it is further prone to loosening.

It is common for the nut to be over tightened by musicians finding the nut loose. Once the nut is over tightened, its useful life is near completion. It cannot be successfully tightened again. The most common short term effect of this problem, besides wobbling and rattling, is short circuited signal wires eventually becoming detached from the input jack. As the unhappy musician repeatedly attempts tightening the nut on the jack, the jack rotates inside the mounting hole. This twists the signal wires further together until one or more wires finally break.

A very common event initiating a sequence of destruction, besides over tightening, is stepping on the guitar cord while plugged into the instrument. This pulls on the weak wedge and bends it past center, thus ending the short useful life of the standard Telecaster® guitar input jack.

A few electric guitars do not use a mounting plate for the jack. Instead, the jack is mounted directly to the guitar body via a hole drilled in the guitar and accepting the jack ferrule. This leaves the guitar body surface around the jack vulnerable to damage from the male jack, as there is no protective plate. In other words, as the musician attempts to insert the male jack it hits and damages the guitar body.

In all mounting cases, a nut on the outside of the jack is employed, leaving the jack protruding from the guitar body, or surrounding surface, at least the thickness of the nut. This not only gives a very small target area, i.e., area accepting the male jack by simply pushing toward the guitar body, but also works to deflect the male input jack away from the hole. The musician blindly searches for the jack hole when attempting to plug-in the signal cord for connection to the amplifier. Once the protrusion of the female jack is located, the musician attempts to guide the ¼ inch diameter male jack into the ¼ inch hole of the female jack. This can require several attempts and often leads the musician to flip over the instrument to see the target hole. Also, nuts fastening the jack to the plate are thin and often become loose, due to contact with only two or three threads.

FIGS. 3A, 3B, and 4 illustrate a prior art input jack configuration and mounting hardware. This is the standard unit utilized by the Fender Telecaster® guitar and others since 1950. Installation of this unit starts with the drilling of a ⅞ inch mounting hole 10. A wedge 15, is pushed into the mounting hole 10. The diagonal measurement of the wedge 15 is slightly more than the ⅞ inch diameter of the mounting hole 10. The wedge 15 is bent inward at the center to shorten it and allow placement in the mounting hole 10 in orientation parallel to the outside of the guitar body 5. The threaded ferrule 20 of the female input jack 25 fits through a hole 30 in the wedge 15 as the input jack 25 passes through the mounting hole 10 from inside the guitar body 5. The threaded ferrule 20 then passes through a hole in the outer cup 35. The outer cup 35 is stamped 0.034 inch thick steel. A nut 40 tightens down against the outer cup 35 and forces the wedge 15 to lodge into the walls of the mounting hole 10 as wedge 15 straightens. If wedge 15 is bent beyond center, it shortens in length, loosens and the whole assembly falls. Unique to the Telecaster® guitar, a flat area 36 formed on the guitar body 5 in accordance with the input jack 25 location allows the outer cup 35 to rest flush against the guitar body 5.

A second embodiment of prior art input jack configuration and mounting hardware appears in FIGS. 5 and 6. A mounting plate 45 fastens to the guitar body 5 via four #3 or #4 wood screws 50. The mounting plate 45 is curved to match the radius of the guitar body 5. The threaded ferrule 20 of the input jack 25 passes through a hole in the mounting plate 45. A backing nut 41 adjusts the amount of ferrule protruding through the mounting plate 45. The nut 40 is tightened down against the outside of the mounting plate 45.

A third embodiment of prior art input jack and mounting hardware appears in FIGS. 7 and 8. The guitar body 5 is drilled with a hole 48 for clearance of the ferrule 20 of the input jack 25. The ferrule 20 passes through the hole 48 from inside the guitar body 5 and a washer 50 resides under nut 40.

Illustrated in FIGS. 9A–9D show the previously discussed prior art input jack 25 mounting methods and corresponding target area 13. As the male half 55 of the input jack 25 approaches, the musician's goal is to quickly and conveniently connect input jack 25. To achieve this goal, the end of the male half 55 must fall within a 0.049 square inch target area 13. If the male half 55 lands outside the target area 13 (FIG. 9A) the male half 55 wedges between the outer cup 35 and the nut 40. In FIG. 9B, the male half 55 is either stopped at the plate 45 or it slides off the plate 45 and impacts with the guitar body 5. In FIG. 9C, the male half 55 is most likely deflected away from the target area 13 and impact the guitar body 5.

Thus, prior mounting arrangements for electric guitar jacks suffer from a tendency to loosen during use and a tendency to frustrate the musician when inserting the male plug into the female jack. It would be desirable, therefore, to improve both the structural mounting features of an electrical guitar jack while also making more convenient the insertion of the male plug into the electric guitar jack. The subject matter of the present invention addresses these concerns in a jack base for electrical musical instruments.

SUMMARY OF THE INVENTION

The present invention provides a solid and secure base for the input jack of electric guitars. One embodiment is a direct replacement for the stock Telecaster® guitar jack mounting system and fits any number of corresponding models employing the same system. This embodiment serves as standard equipment on virtually any electric guitar. As a Telecaster® guitar replacement, it requires no modifications and causes no damage to the instrument. This makes replacing the old part simple and also preserves value to collectors as there are no irreversible changes made to the instrument. Simple installation makes the present invention valuable as an original equipment item as this saves production time at the factory.

A smooth dish shape, e.g., continuous concave surface, structure provides the jack base exposed surface and guides the male input jack directly into the hole of the female half. The target area of the jack base is twelve times that of the prior art jack mounting systems. The heads of two mounting screws rest flush with the jack base concave surface. A lateral orientation angle for the mounting screws sends the screws out the side of the base at a 38 degree angle and into the inside of the mounting hole. This improved installation prevents the screws from stripping directly out of the wood, i.e., the screws cannot travel laterally through the guitar body material. The female jack is threaded into the center of the jack base and need not protrude from the concave surface. These threads combined with a locking nut provide more thread to thread contact relative prior art structures. Hence, more friction exists to maintain the jack mounting to the base.

BRIEF DESCRIPTION OF DRAWINGS

In order that the present invention be more readily understood and put into practical effect, reference will now be made to the accompanying drawings which illustrate a preferred embodiment of the invention and wherein:

FIGS. 9A–9C are views taken along line D—D of FIG. 2 and FIG. 9D shows a target area of several prior art jacks.

DETAILED DESCRIPTION OF THE PREFERRED EMBODIMENT

Figure 1:
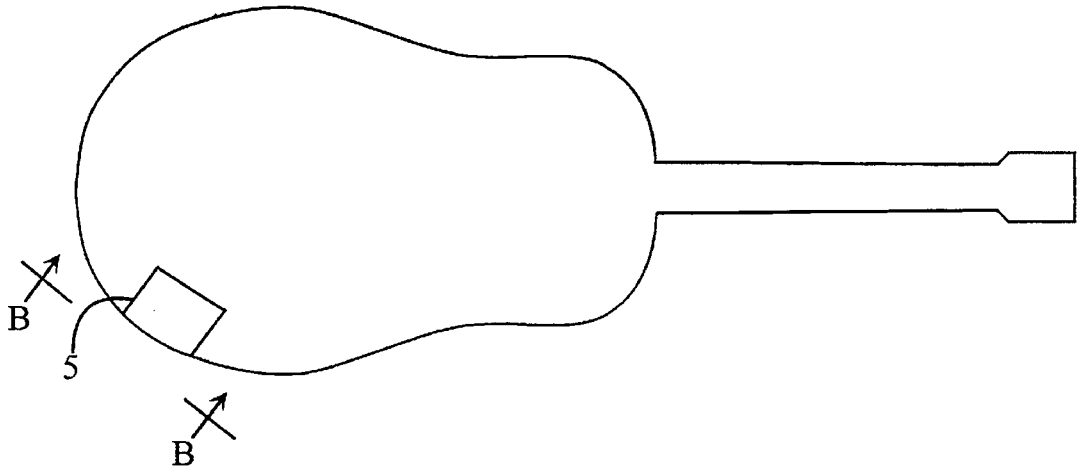
FIG. 1 is a front view of an electric guitar with a small cut out representing the mounting area for an input jack.
Figure 2:
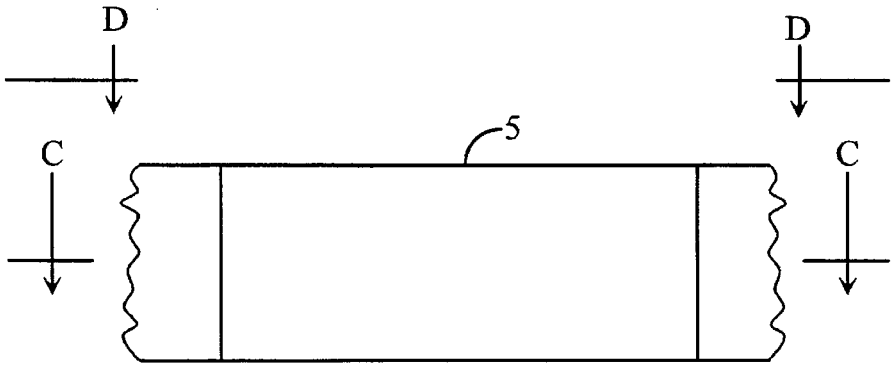
FIG. 2 shows edge of the guitar body as taken along line B—B of FIG. 1.
Figure 3A:
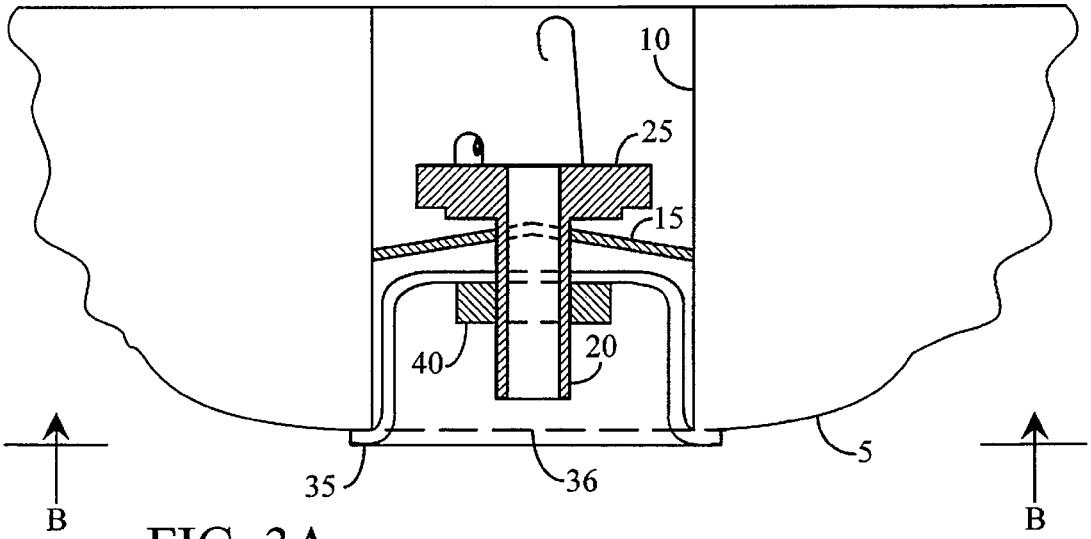
FIG. 3A (Prior Art)
FIG. 3A is a sectional view of a prior art jack mounting configuration taken along line C—C of FIG. 2.
Figure 3B:
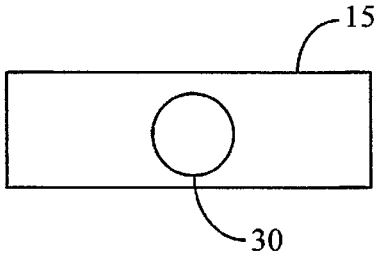
FIG. 3B (Prior Art)
FIG. 3B shows a mounting wedge for the configuration of FIGS. 3A and 4.
Figure 4:
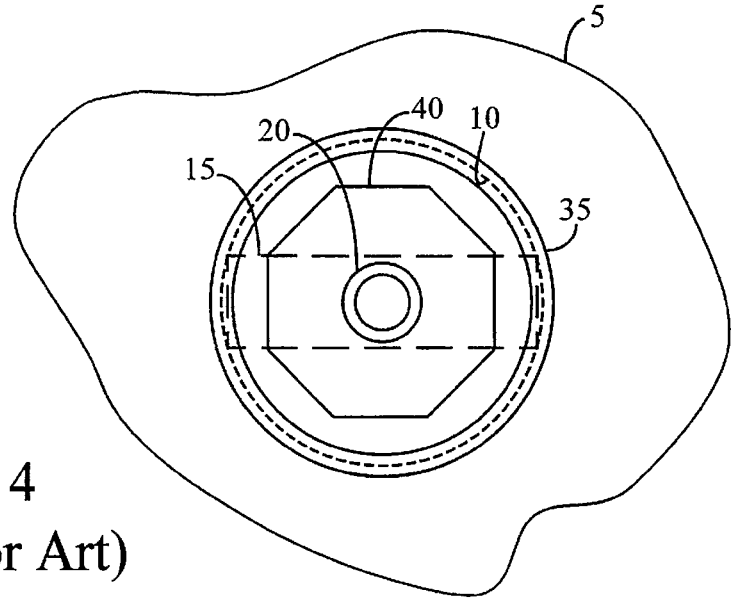
FIG. 4 (Prior Art)
FIG. 4 is a plane view taken along line B—B of FIG. 3.
Figure 5:
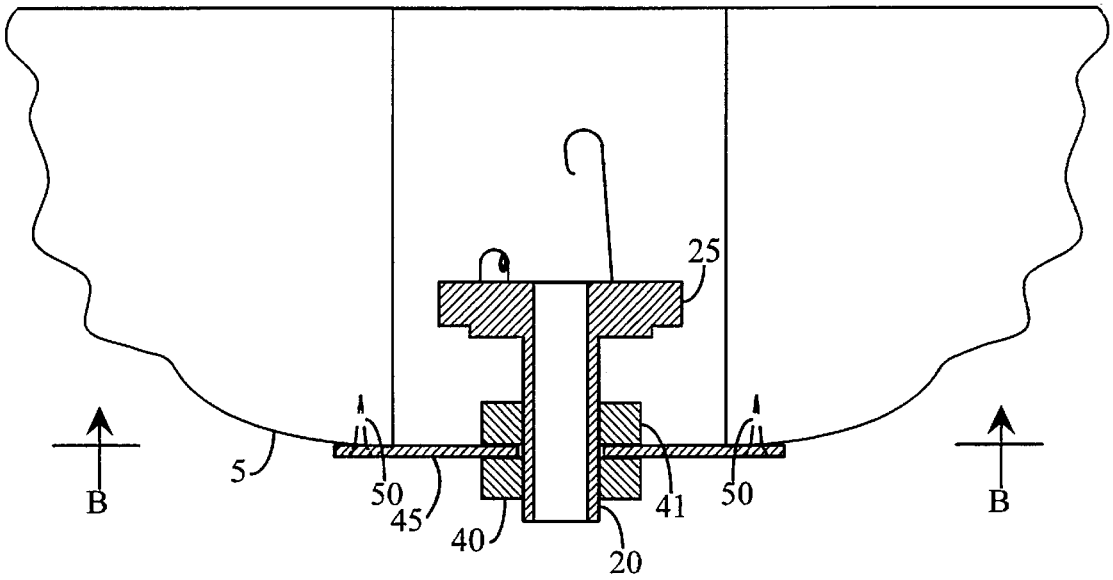
FIG. 5 (Prior Art)
FIG. 5 is a sectional view of another prior art input jack mounting configuration as taken along line C—C of FIG. 2.
Figure 6:
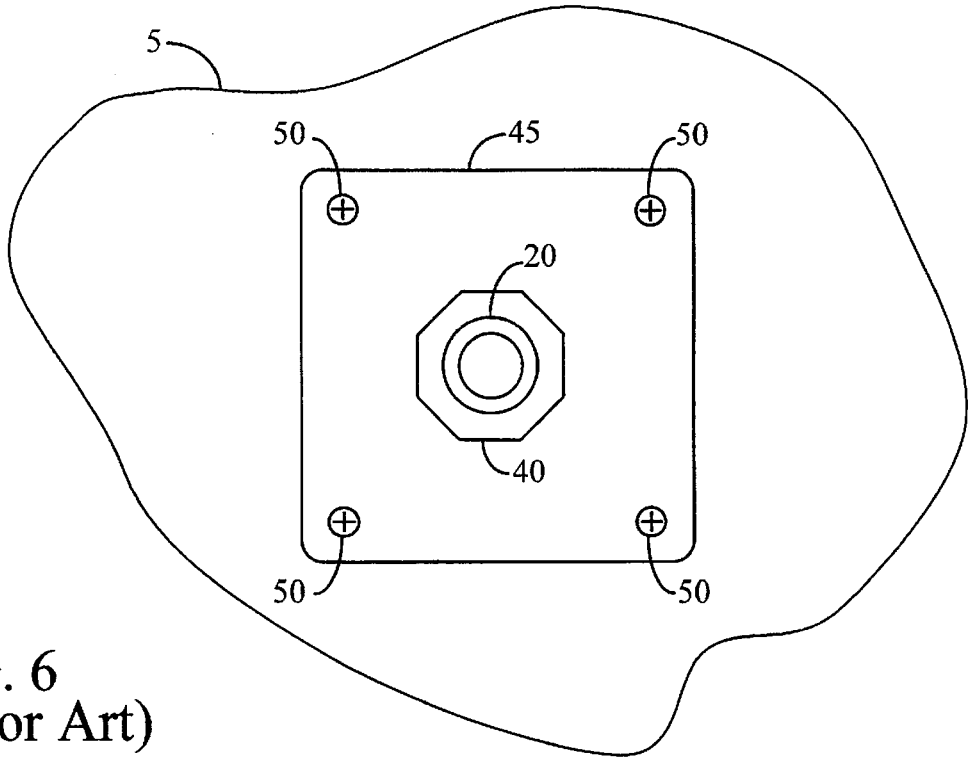
FIG. 6 (Prior Art)
FIG. 6 is a plane view taken along line B—B of FIG. 5.
Figure 7:
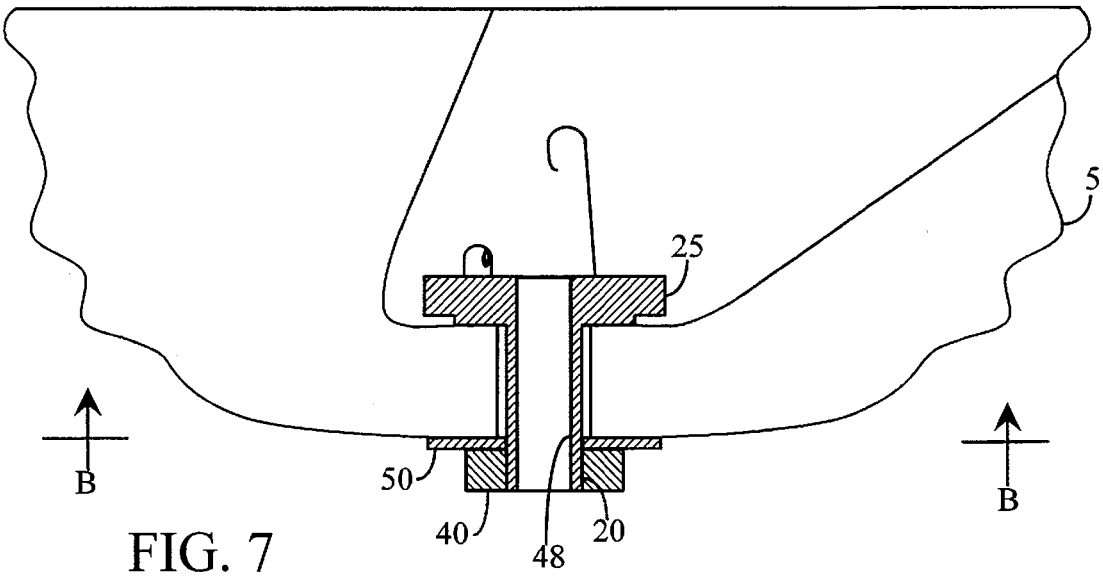
FIG. 7 (Prior Art)
FIG. 7 is a sectional view of another prior art input jack mounting configuration taken along line C—C of FIG. 2.
Figure 8:
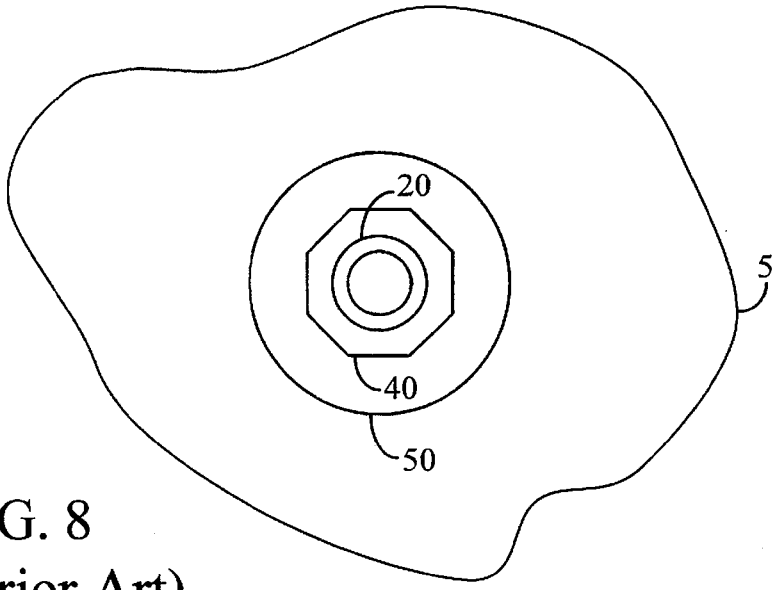
FIG. 8 (Prior Art)
FIG. 8 is a plane view taken along line B—B of FIG. 7.
Figure 10:
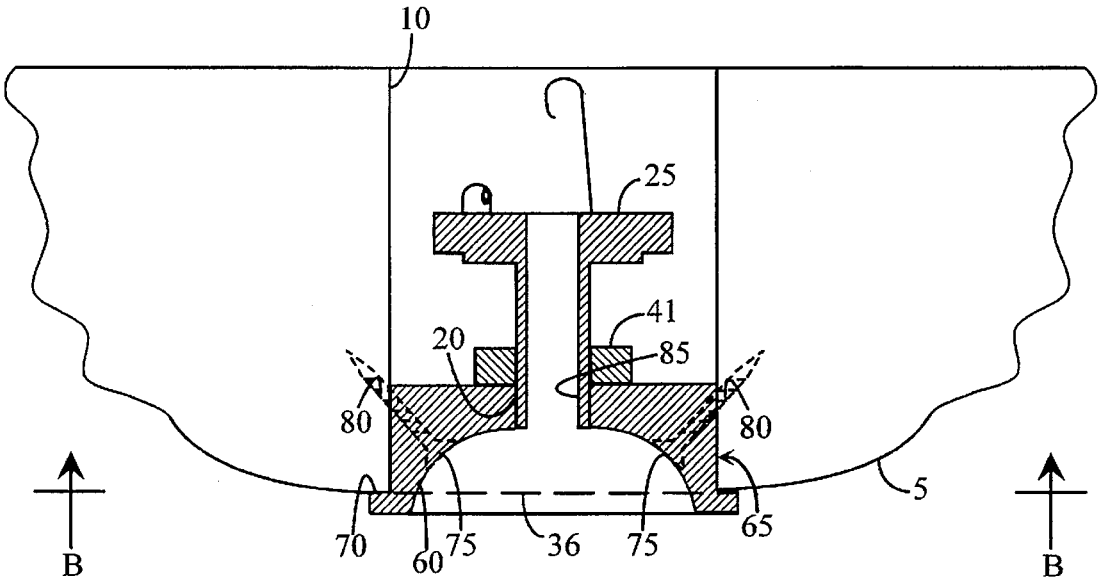
FIG. 10 is a sectional view of an embodiment of the present invention as taken along line C—C of FIG. 2.
Figure 11:
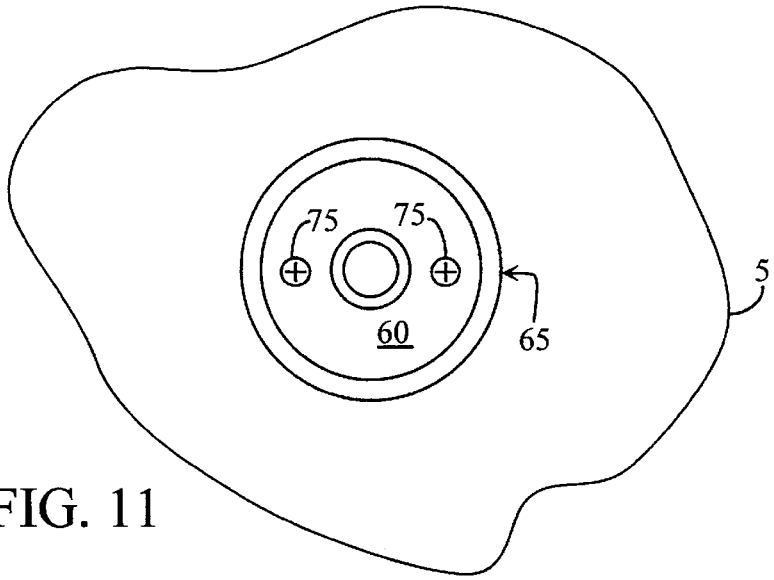
FIG. 11 is a plane view taken along line B—B of FIG. 10.

FIGS. 10 and 11 illustrate an embodiment of the present invention. This design works as a direct replacement for the standard input jack mounting system found on the Fender® Telecaster® guitar and similar models. The device of the present invention mounts in the existing ⅞" jack mounting hole 10 and can be machined from a solid piece of round aluminum bar stock. Thus, jack base 65 assumes a generally cylindrical external configuration and inserts into the pre-existing jack mounting hole 10 as illustrated in FIG. 10. The front outer surface 60 of the jack base 65 is concave, forming a spherical shape nearly reaching the outer edge of the base 65. This outer most edge of the base forms a lip 70 resting against the guitar body 5 when screwed into place. The two #6 flathead screws 75 secure the base 65 in place at 76 degrees relative to each other. The screws 75 protrude relative to jack base at a 38 degree angle. The screw holes 80 in the jack base 65 are drilled midway between outer edge of the concave radius arc and the edge of the ⅜ inch threaded hole 85 in the center of the base. The screw holes 80 are countersunk, leaving the heads of the screws 75 flush with the base concave surface 60. This gives the male jack 55 an obstacle-free path to the opening of the female jack 25 as it slides along the concave surface 60 of the jack base 65.

This greatly increases the amount of material to be displaced for the screw 75 to be ripped out, as it can not be pulled straight out, but rather must travel sideways through the material of guitar body 5. The jack 25 is mounted to the jack base 65 via the threaded hole 85 in the center of the jack base 65 which engage the threads on the ferrule 20 of the female jack 25. The jack 25 is threaded into the hole till the end of the ferrule 20 is flush with the concave outer surface 60. A locking nut 41 is tightened down on the back of the jack base 65. The threaded hole 85 in the base 65 is two to three times longer than the threads of the nut 40 normally used on the outside of the jack plate. This makes it much less likely to loosen during use, due to the increased friction provided by a greater number of engaged threads.

Figure 12:
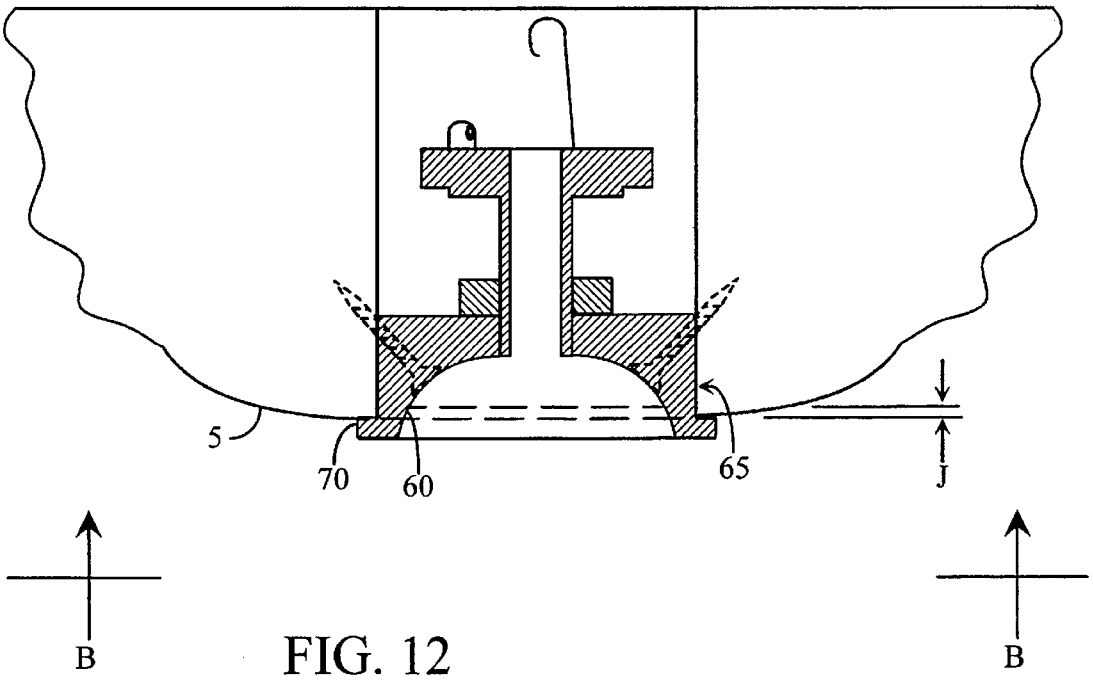
FIG. 12 is a sectional view of an embodiment of the present invention taken along line C—C of FIG. 2.
Figure 13:
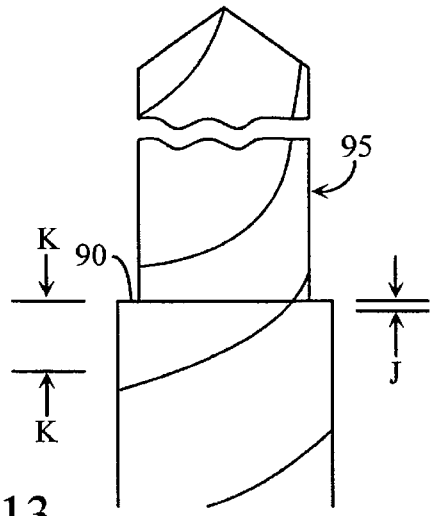
FIG. 13 is a side view of a stepped drill.
Figure 14:
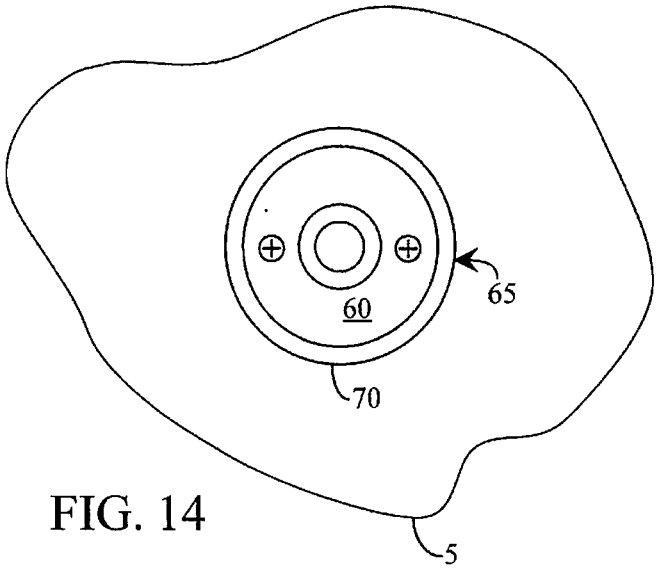
FIG. 14 is a plane view taken along line B—B FIG. 12.

FIGS. 12, 13, and 14 illustrate a modified mounting for the embodiment of the present invention as illustrated in FIGS. 10 and 11. Instead of making a flat spot 36 in the guitar body 5 perimeter flush to the outer lip 70, a step drill 95 establishes the mounting hole 10. The step 90 is drilled to depth J. The depth J is the point at which the step 90 in the drill 95 makes full contact with the guitar body 5. This allows the lip 70 of the jack base 65 to rest flush against the guitar body 5.

Figure 15:
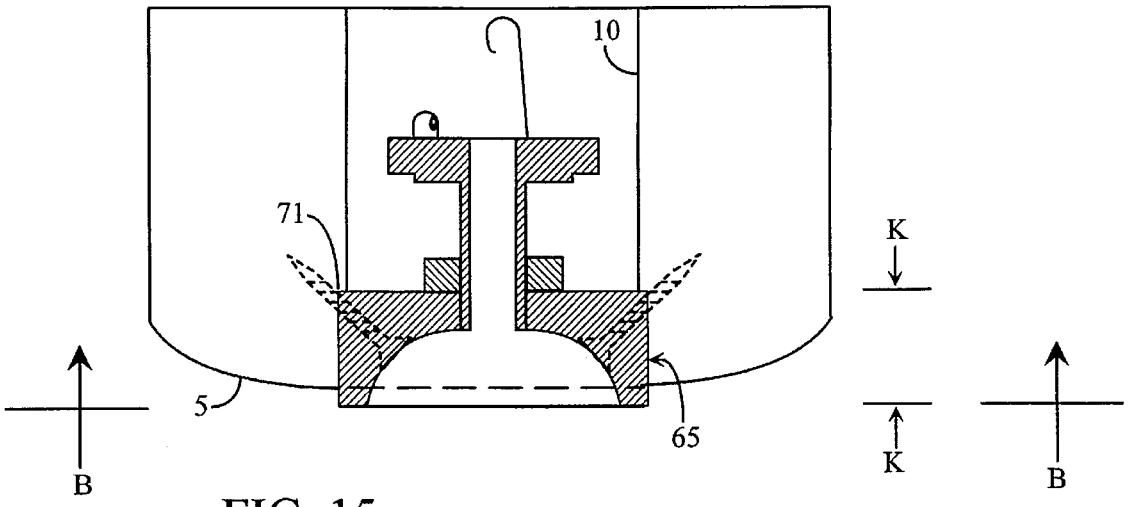
FIG. 15 is a sectional view of an embodiment of the present invention taken along line C—C of FIG. 2.
Figure 16:
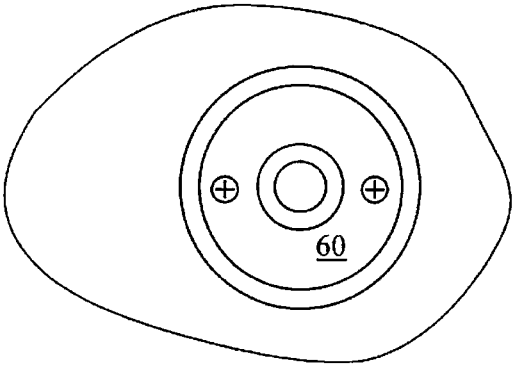
FIG. 16 plane view taken along line B—B of FIG. 15.

FIGS. 15 and 16 illustrate a second embodiment of the present invention. In this embodiment, the jack base 65 has no outer lip 70. Instead, the jack base rests on a step 71 in the mounting hole 10. A step drill 95 is drilled to depth K. This embodiment works on a curved surface or flat surface guitar body 5.

Figure 17:
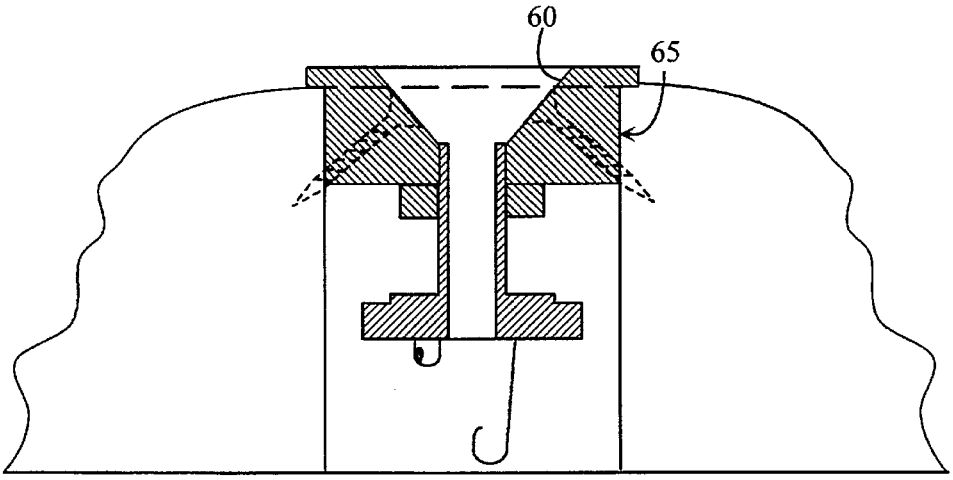
FIG. 17 is a sectional view of another embodiment of the present invention taken along line C—C of FIG. 2.

Illustrated in FIG. 17 is another embodiment of the present invention. The outer concave surface 60 of the jack base 65 is not curved, but rather cone shaped. The outer surface, therefore, need not be a perfect radius to achieve the goal of guiding the male half 55 into the input jack 25.

Figure 18:
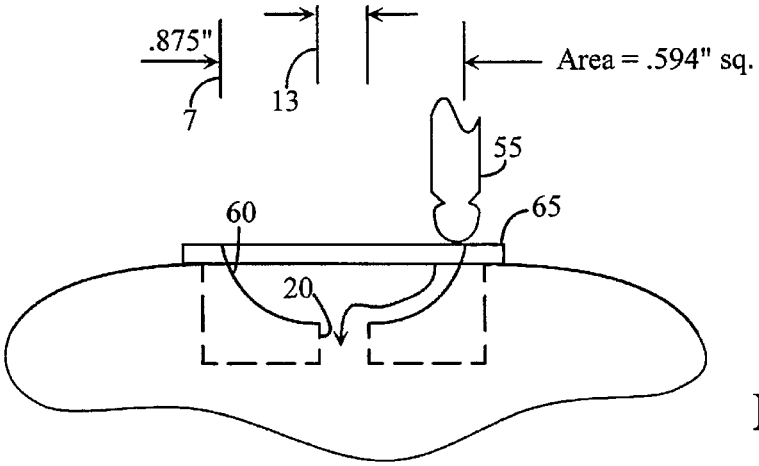
FIG. 18 is a plane view taken along line D—D of FIG. 2 showing the target area 7 of the present invention.

FIG. 18 illustrates the target area 7 of the present invention relative to the target area 13 of prior art. The present invention has a target area 7 of 0.594 inch square. The outer surface 60 of the jack base 65 works like a funnel, guiding the male half 55 into the ferrule 20 of the input jack 25. This gives the present invention over 12 times the target area 13 of prior art.

In each embodiment of the present invention, a concave surface guides the male jack 55 to the opening of the ferrule 20. No protrusions or surface structures of the jack base present opposition to smooth uninhibited movement of the male half 55 into the ferrule 20 of the input jack 25. The musician enjoys greater opportunity to insert the male half 55 without directly observing the operation, i.e., without flipping over the instrument to view the input jack. Further, the present invention provides improved structural integrity and mounting of the jack base to avoid undesirable loosening of the jack base and loss of electrical connection relative to the input jack.

Despite significant modification in the structure and mounting of the jack plate, the present invention requires no irreversible modification to the guitar itself. Many electric guitars are considered collector items, and irreversible modification to the guitar body is unacceptable, or at least undesirable. Thus, the present invention provides advantage not only in ease of insertion and mounting security, but also in preservation of the musical instrument relative to its original condition.

The present invention is relatively simple to manufacture, as it requiring no molds, dies, or complex tooling. It can be manufactured in production quantities at practical cost, on standard CNC machinery, from aluminum bar stock. The jack base could be manufactured, possibly more cost effectively for large scale runs, with the use of injection molding or lost cast forming.

What is claimed is:

1. A jack base for an electrical musical instrument including a jack base mounting hole, said jack base comprising:

an external surface corresponding in shape to said mounting hole and allowing placement of said jack base in said mounting hole; and a concave surface exposed when said jack base is placed in said mounting hole, said concave surface including an aperture accepting a male jack therethrough, said concave surface remaining exposed after placement of said jack through said aperture.

2. A jack base according to claim 1 wherein said mounting hole and said external surface are generally cylindrical with a diameter of said external surface being less than that of said mounting hole.

3. A jack base according to claim 1 wherein said concave surface is one of spherical and conical.

4. A jack base for an electrical musical instrument including a jack base mounting hole, said jack base comprising:

an external surface corresponding in shape to said mounting hole and allowing placement of said jack base in said mounting hole; and a concave surface exposed when said jack base is placed in said mounting hole, said concave surface including an aperture accepting a male jack therethrough, said aperture being an internally threaded aperture accepting a jack ferrule threadably therein whereby a terminal end of said ferrule may be positioned flush with said concave surface.

5. A jack base for an electrical musical instrument including a jack base mounting hole, said jack base comprising:

an external surface corresponding in shape to said mounting hole and allowing placement of said jack base in said mounting hole; and a concave surface exposed when said jack base is placed in said mounting hole, said concave surface including an aperture accepting a male jack therethrough;

at least one mounting aperture coupling said concave surface and said external surface; and at least one mounting screw insertable through said mounting aperture to engage interior walls of said mounting hole and secure said jack base therein.

6. A jack base according to claim 5 wherein said mounting hole is cylindrical and defines a central axis and said at least one mounting aperture and said at least one mounting screw bear non-parallel relation to said central axis when said jack base resides within said mounting hole and said at least one mounting screw resides within said at least one mounting aperture.

7. In combination, an electric guitar including a generally cylindrical jack base mounting hole; and a jack base insertable within said mounting hole, said jack base including a generally cylindrical exterior surface in face-to-face relation to said mounting hole when said jack base inserts therein, a concave surface exposed when said jack base inserts within said mounting hole, a jack aperture at a deepest point of said concave surface, a mounting arrangement for a jack ferrule allowing positioning of an opening of said ferrule concurrent with said concave surface, and a jack base mounting arrangement coupling said exposed concave surface and said guitar mounting hole while maintaining said concave surface continuous whereby said ferrule threadably engages said jack base and said jack opening of said ferrule is positioned concurrent with said concave surface.

8. A combination according to claim 7 wherein said concave surface is one of spherical and conical.

9. A combination according to claim 7 wherein said jack ferrule mounting arrangement comprises threads within said jack aperture receiving external threads of said jack ferrule.

10. A combination according to claim 7 wherein said jack base mounting arrangement comprises at least one mounting screw and at least one mounting screw aperture coupling said concave surface and said cylindrical surface whereby said mounting screw positioned within said mounting screw aperture engages said concave surface and said mounting aperture to secure said base within said mounting aperture.

11. A combination according to claim 10 wherein said mounting hole defines a central axis and said mounting screw aperture lies in non-parallel relation to said central axis when said jack base inserts within said mounting aperture.

12. A jack base for electrical musical instrument, said jack base comprising:

a monolithic block defining at its exterior surface a generally cylindrical configuration and defining at one end of said generally cylindrical configuration a concave surface, said block including a threaded jack mounting aperture coupling a deepest point of said concave surface and an opposite end of said generally cylindrical configuration, said block further including at least one mounting screw aperture having a counter sunk portion at said concave surface and extending to said exterior surface and including a mounting screw insertable through said mounting screw aperture and cooperative with the counter sunk portion thereof to provide at a head of said screw a continuous portion of said concave surface and at a threaded opposite end of said screw engagement of a musical instrument into which said jack inserts.

13. A jack base according to claim 12 wherein said generally cylindrical configuration defines a central axis and said mounting screw aperture lies in non-parallel relation to said central axis.

14. A jack base according to claim 12 further comprising a second mounting screw aperture and a second mounting screw.

* * * * *